United States Patent [19]

Hall Jr. et al.

[11] 4,204,681

[45] May 27, 1980

[54] GAME BALL RACKET WHEREIN CERTAIN RACKET COMPONENTS ARE STRUCTURALLY INTEGRATED WITH THE RACKET FRAME BY THE STRING WITH WHICH THE RACKET IS STRUNG

[75] Inventors: Harleston J. Hall Jr., Princeton; Roger I. Sassin, Morganville; Drew J. Yuhas, Cranbury, all of N.J.

[73] Assignee: AMF Incorporated, Plainsboro, N.J.

[21] Appl. No.: 924,154

[22] Filed: Jul. 13, 1978

[51] Int. Cl.[2] ..... A63B 49/00

[52] U.S. Cl. ..... 273/73 C; 273/73 D; 273/73 G

[58] Field of Search ..... 273/73 R, 73 C, 73 D, 273/73 G, 73 H

[56] References Cited

U.S. PATENT DOCUMENTS

| | | | |
|---|---|---|---|
| 1,942,479 | 1/1934 | Kleinman | 273/73 D |
| 2,178,588 | 11/1939 | Kleinman | 273/73 D |
| 3,702,701 | 11/1972 | Vaughn | 273/73 G |
| 4,042,238 | 8/1977 | Theriault | 273/73 C |
| 4,046,377 | 9/1977 | Khazzam | 273/73 G |
| 4,066,260 | 1/1978 | Rodgers | 273/73 C |

FOREIGN PATENT DOCUMENTS

| | | | |
|---|---|---|---|
| 212195 | 3/1924 | United Kingdom | 273/73 G |

*Primary Examiner*—Charles E. Phillips
*Attorney, Agent, or Firm*—Carella, Bain, Gilfillan & Rhodes

[57] ABSTRACT

A bumper strip surrounding the upper peripheral portion of a racket and for providing protection against injury to another player and to painted surfaces of a playing court is structurally integrated with the racket frame by passing string with which the racket is strung through the holes formed in the bumper strip whereby upon the string being tightened, the bumper strip is forced into engagement with the racket frame and whereby upon the bumper strip being removed the racket is rendered inoperable for play; and/or, a throatpiece is structurally integrated with the racket frame by passing the string through holes formed in the throatpiece which string upon being tightened in cooperation with projections extending outwardly from the sides of the throatpiece and extending into holes formed in the racket frame structurally integrates the throatpiece and the frame. The projections formed on the side of the throatpiece and the frame holes within which they are received permit limited flexing rotation between the throatpiece and the frame which accommodates the torsional rotation experienced by the frame in the throatpiece area upon a ball impacting the racket.

1 Claim, 16 Drawing Figures

GAME BALL RACKET WHEREIN CERTAIN RACKET COMPONENTS ARE STRUCTURALLY INTEGRATED WITH THE RACKET FRAME BY THE STRING WITH WHICH THE RACKET IS STRUNG

BACKGROUND OF THE INVENTION

1. Field of the Invention

This invention relates generally to a new and improved game ball racket, and in particular, relates to a game ball racket wherein certain components such as a bumper strip and/or a throatpiece are structurally integrated with the racket frame by the string with which the racket is strung.

2. Description of the Prior Art

Many game ball rackets are known to the prior art. However, most presently known prior art game ball rackets have their components structurally integrated by metal fasteners such as screws, rivets, or by various joining techniques such as welding and brazing in the case of metal rackets and gluing in the case of wooden rackets. As is known to those skilled in the art of manufacturing game ball rackets, the reduction or elimination of manufacturing steps involved in using such prior art structural uniting techniques will result in an ease of manufacture with an attendant lower manufacturing cost due, primarily, to the reduction in manufacturing time.

With further regard to the prior art game ball rackets, and particularly with regard to the prior art racquetball rackets, it is generally required that the upper peripheral portion of game racquetball rackets be covered with a bumper strip for providing protection against inadvertent injury of one player by another player in swinging the racket and for protecting against damage to the wall surfaces of the court in which the racquetball game is played. As is known, may racquetball players improperly remove the bumper strip thereby increasing the danger and frequency of injury to other players and damage to the walls of the racquetball court. Accordingly, there exists a need in the game ball racket art, particularly the racquetball racket art, of a racquetball racket wherein the bumper strip is structurally united with the racket frame such that upon the bumper strip being removed the racket is rendered inoperable for play. Thus, it is a specific object of the present invention to provide a game ball racket, e.g. a racquetball racket, wherein the bumper strip is structurally united with the racket frame such that upon the bumper strip being removed the racket is rendered inoperable for play.

As is further known to those skilled in the game ball racket art, and particularly those skilled in the art of manufacturing metal rackets provided with a plastic throatpiece or yoke, such plastic throatpieces and metal frame are typically structurally united by metal screws which technique has provided a major advance in the racket art and has proven to be enormously successful. However, as will be understood by those skilled in the art of manufacturing game ball rackets, a still further improvement in the manufacture of such rackets can be provided if the assembly step of structurally uniting the throatpiece and the metal frame with the metal screws can be improved. Accordingly, it is a further specific object of the present invention to provide an improved game ball racket wherein the throatpiece of the racket is structurally united with the racket frame without the use of any permanent fasteners or joining techniques such as the above noted welding, brazing, riveting techniques.

As is still further known to those skilled in the game ball racket art, upon a ball and game ball racket impacting, the portions of the racket frame engaging the throatpiece or yoke of the racket experience torsional stress and at least limited torsional rotation with the opposed portions of the racket frame engaging the sides of the throatpiece experiencing limited torsional rotation in the opposite directions. This phenomenon, as is further known, tends to weaken the structural integration between the racket frame and the throatpiece and can ultimately fracture and destroy such structural integrity such as by breaking the rivets, or weld or braze. Accordingly, it is a further specific object of the present invention to provide structural integration between a game ball racket and its throatpiece which accommodates such torsional rotation by permitting limited relative rotational movement between the throatpiece and the portions of the racket frame engaging the sides of the throatpiece.

SUMMARY OF THE INVENTION

The upper peripheral portion of a game ball racket, such as a racquetball racket, is surrounded with a bumper strip provided with a plurality of holes formed therealong for receiving the string with which the racket is strung whereby upon the string being tightened the bumper strip is forced into tight engagement with the racket frame and structurally united with the racket and whereby upon the bumper strip being removed the string must be removed and the racket rendered inoperable for play.

A throatpiece is structurally integrated with the racket frame by passing the string through holes formed in the throatpiece which string upon being tightened cooperates with projections extending outwardly from the sides of the throatpiece and extending into holes formed in the racket frame to structurally integrate the throatpiece and the frame. The projections formed on the side of the throatpiece and the frame holes within which they are received permit limited rotation between the throatpiece and the frame which accommodates the torsional rotation experienced by the frame in the throatpiece area upon a ball impacting the racket.

DESCRIPTION OF THE DRAWINGS

FIG. 1B is a diagrammatic view identifying portions of the racquetball racket frame and illustrating the assembly of the throatpiece or yoke and the frame;

DESCRIPTION OF THE PREFERRED EMBODIMENT

Figure 1A:
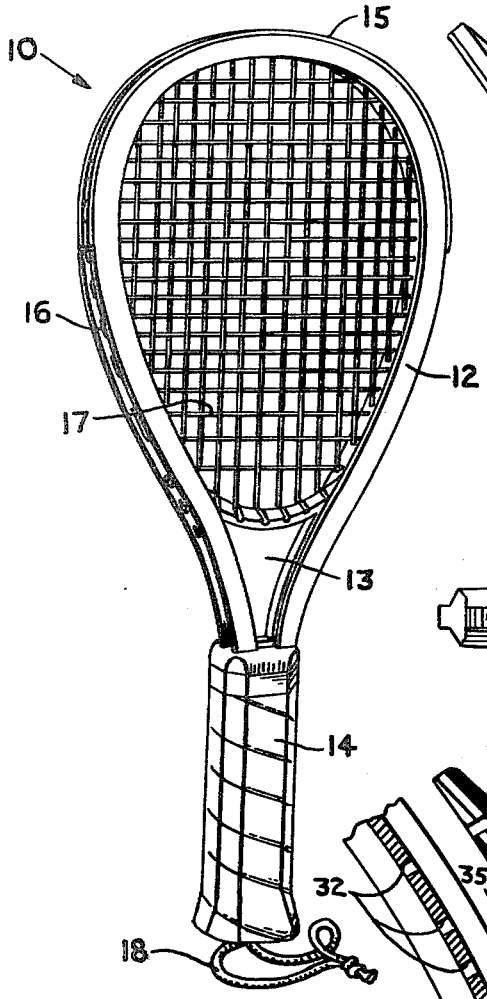
FIG. 1A is a perspective view of an improved racquetball racket embodying the present invention and FIG. 1B is a diagrammatic illustration of a game ball racket wherein relative portions of the frame are identified.
Figure 2:
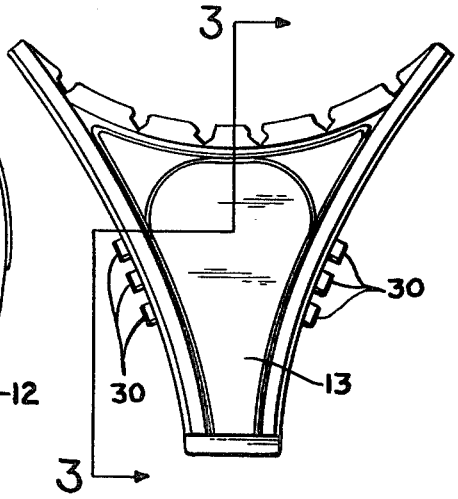
FIGS. 2, 3, 4 and 5 are, respectively, front, side, top, and vertical sectional views of a throatpiece or yoke, with FIG. 5 further including a partial showing of those portions of the racket frame engaging the sides of the throatpiece.
Figure 3:
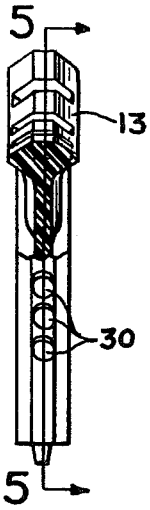
Figure 4:
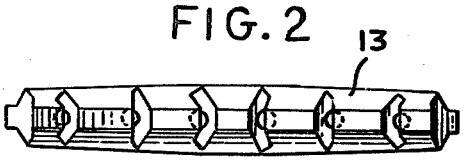

Referring now to the drawings, and in particular to FIG. 1A, there is shown a game ball racket, for example a racquetball racket, indicated by general numerical designation 10 and embodying the present invention. The racket may include a frame 12, throatpiece or yoke 13, handle 14, bumper strip 15, grommet strip 16, string 17, and a looped thong 18. The frame 12 may be made of a suitable aluminum alloy, the throatpiece 13 may be made of a suitable thermoplastic material such as nylon, the handle 14 may be made, for example, of a suitable solid plastic formed in situ such as the hardened, foamed polyurethane handle as disclosed in U.S. Pat. Nos. 3,702,701 and 3,805,366, and the bumper strip 15 and grommet strip 16 may be made of suitable thermoplastic material such as nylon. The plastic throatpiece 13 may be suitably reinforced with such reinforcing materials as graphite or glass fibers.

Figure 1B:
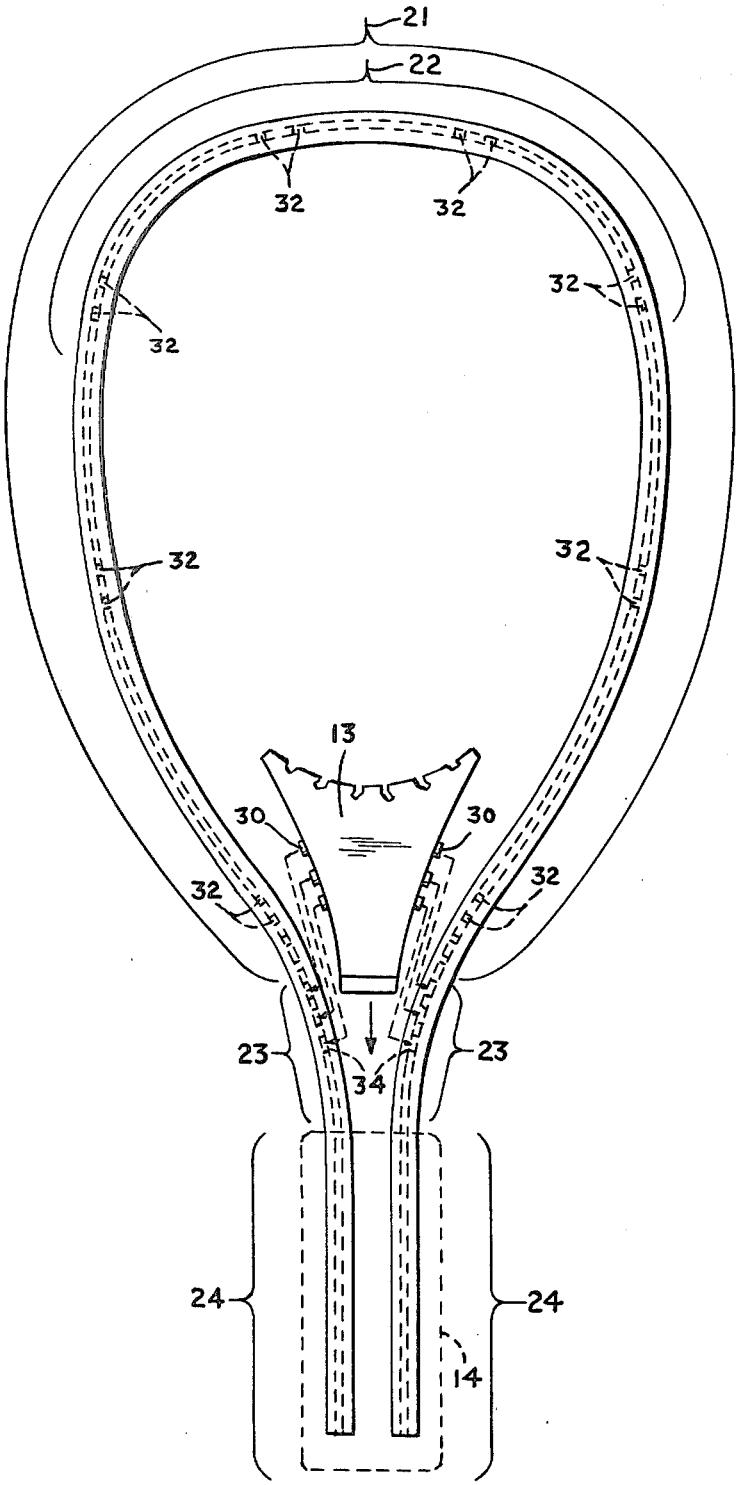

Referring now to FIG. 1B, where relevant portions of the racket frame are identified, it will be understood that in the general context of the present specification and the appended claims, the upper portion of the racket frame is that portion encompassed by bracket 21, the upper peripheral portion of the racket frame is that portion encompassed by bracket 22, the opposed generally intermediate frame portions are those portions encompassed by brackets 23—23, and the opposed generally lower portions on which the handle 14 is provided are those portions encompassed by brackets 24—24. It will be further understood by those skilled in the game ball racket art that such frame portion identifications will vary in accordance with the specific structures of various game ball rackets and that such frame portions are identified to provide a more readily understandable teaching of the present invention.

Figure 15:
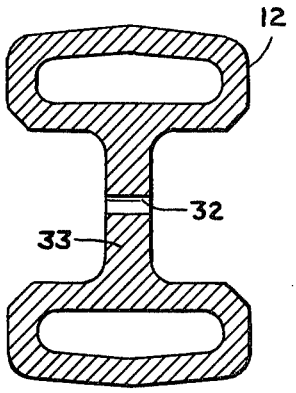
FIG. 15 is a enlarged cross-sectional view taken along the line 15—15 in FIG. 5 and showing a frame cross section.
Figure 13:
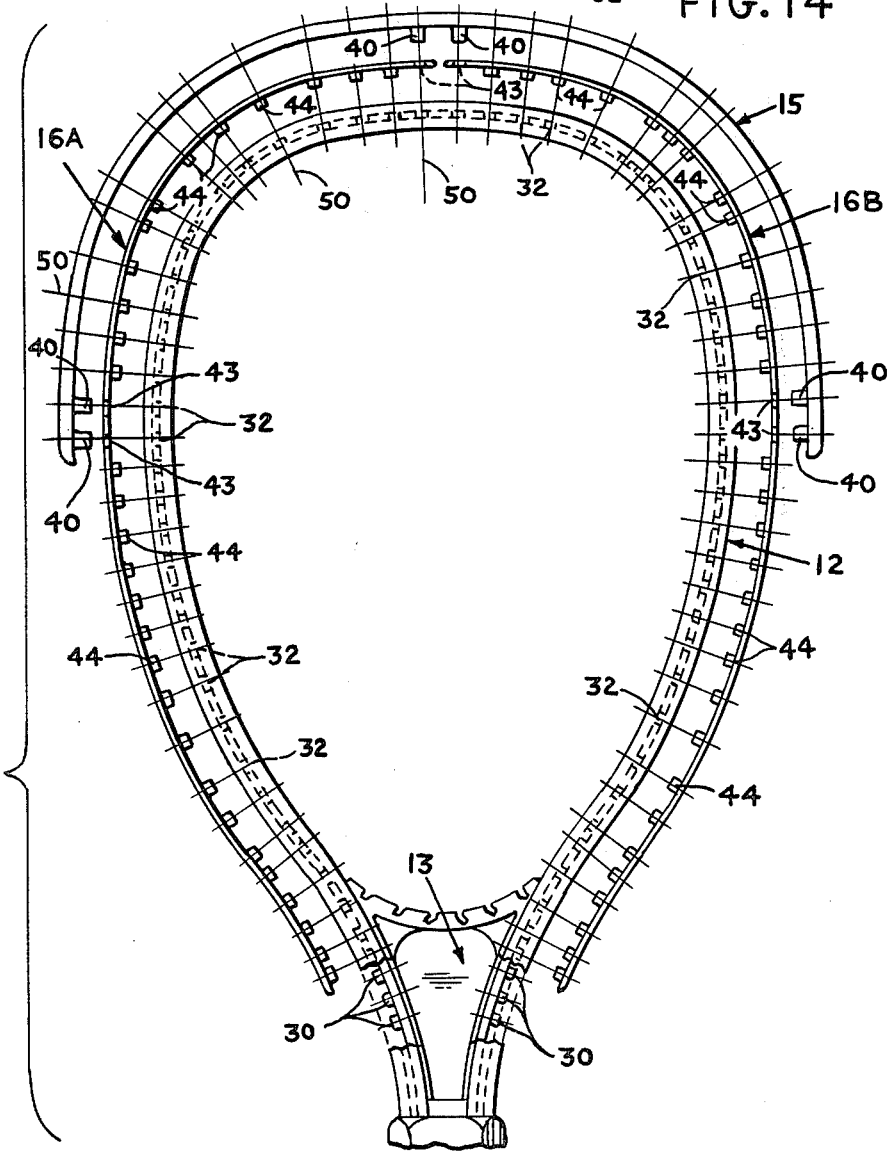
FIG. 13 is a diagrammatic view illustrating the assembly of a game ball racket embodying the present invention.

The frame 12, including upper portion 21 and opposed intermediate portions 23—23 and as may be best seen in FIG. 13, is provided with a plurality of holes 32 formed therealong and for receiving the string 17 as the racket is strung; for clarity only a limited number of such holes 32 are identified. Specifically, as shown in FIG. 15, the holes 32 extend through the frame web 33 and may be suitably formed therealong such as by punching or drilling.

Figure 5:
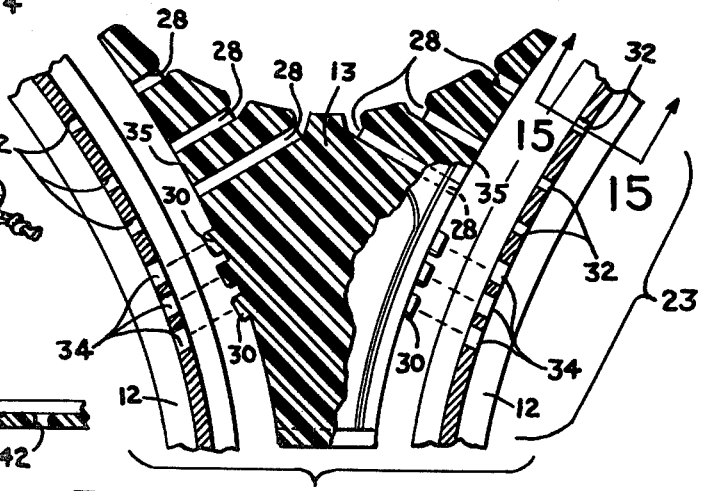
Figure 7:
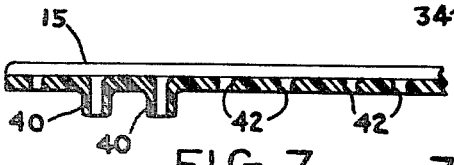
FIGS. 6, 7, 8 and 9 are, respectively, outer side, cross-sectional, inner side and edge views of a bumper strip.
Figure 6:
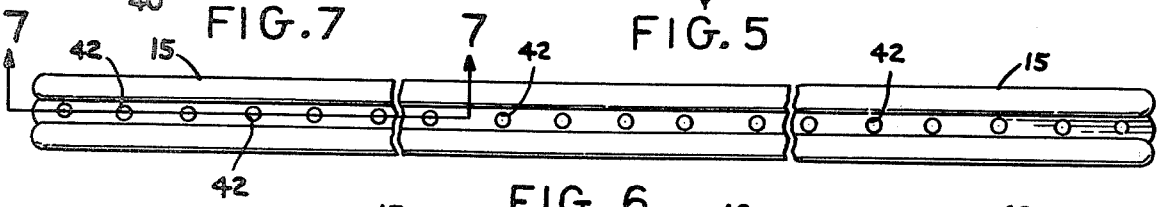
Figure 8:
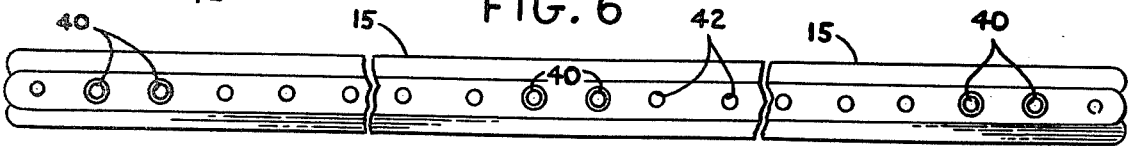
Figure 9:
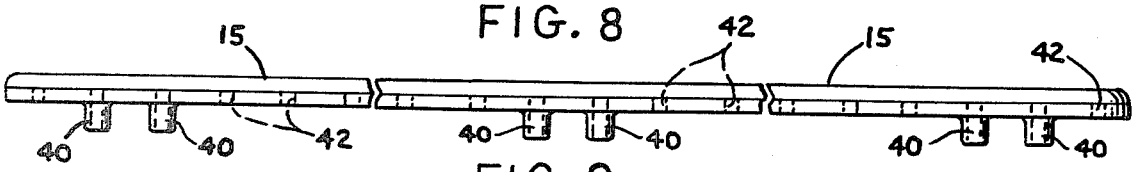

The throatpiece or yoke 13, shown in detail in FIGS. 2, 3, 4 and 5, and as may be best seen in FIG. 5, is provided with a plurality of holes or passageways 28 extending therethrough for receiving the string 17 upon the racket being strung, and which throatpiece is further provided with a plurality of projections or lugs 30 formed on each side thereof and extending outwardly therefrom. As shown in FIG. 5, the opposed generally intermediate frame portions 23 have a plurality of additional holes 34 formed therein extending through the frame web 33 for receiving the throatpiece projections 30.

Referring now to the bumper strip 15, and in particular to FIGS. 6–9, it will be understood that the bumper strip 15 is provided with a plurality of grommets 40 and a plurality of holes 42 formed at predetermined positions therealong; only a limited number of holes 42 being identified for clarity.

Figure 10:
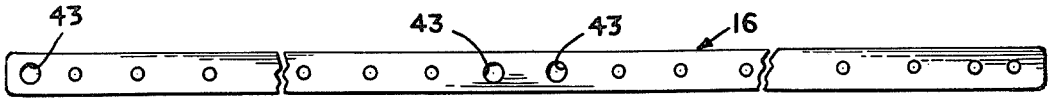
FIGS. 10, 11, and 12 are, respectively, top, bottom and edge views of a grommet strip with FIG. 12 being in partial cross section.
Figure 11:
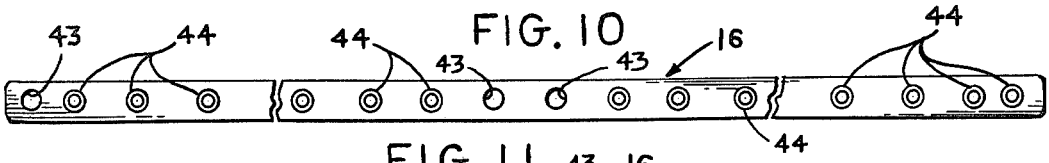
Figure 12:
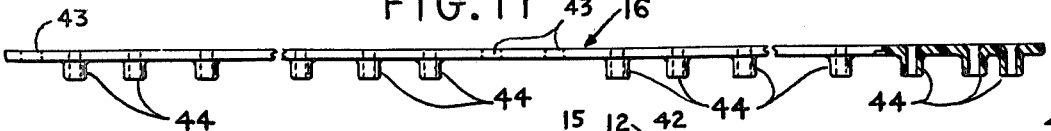

Referring then to FIGS. 10–12, there is shown the grommet strip 16 which is provided with a plurality of holes 43 and grommets 44 at predetermined positions therealong. It will be understood, and as shown in FIG. 13, that the grommet strip 16 may be comprised of two separate grommet strips 16A and 16B or may be comprised of a single grommet strip the combined length of individual grommet strips 16A and 16B. It will be further understood by those skilled in the injection molding art that by making the grommet strip in two individual strips the size of the injection mold may be reduced by substantially one-half with an attendant reduction in mold cost. It will be further understood by those skilled in the art that the individual grommet strips 16A and 16B may be identical in structure and merely reversed in respective positions as shown.

Figure 14:
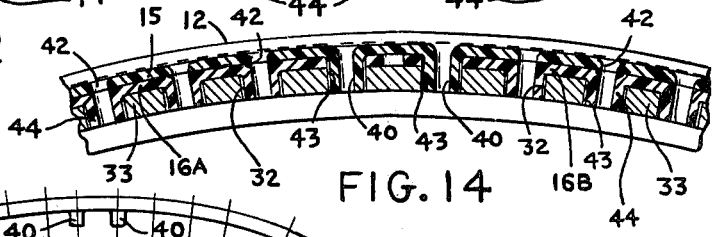
FIG. 14 is a diagrammatic partial cross-sectional view illustrating in detail the assembly of a bumper strip, grommet strip, and frame in accordance with the teachings of the present invention.

As indicated diagrammatically by radially inwardly directed assembly lines 50 of FIG. 13, for assembly, the grommet strip 16A and 16B is placed around the outer upper frame portion 21 (FIG. 1B) with the grommets 44 being aligned with and for insertion into predetermined ones of the holes 32 formed in the frame 12 and with the holes 43 formed in the grommet strip being aligned with predetermined other holes 32 formed in the frame 12. The bumper strip 15 is placed around the upper peripheral portion 22 (FIG. 1B) of the racket frame 12 with the grommets 40 formed on the bumper strip 15 being aligned with the holes 43 formed on the grommet strip 16 and with the holes 42 formed on the bumper strip 15 being aligned with the grommets 44 formed on the grommet strip 16. In further assembly, and as shown in detail in FIG. 14, the grommets 44 formed on the grommet strip 16 extend into predetermined ones of the holes 32 formed in the frame 12 and the grommets 40 formed on the bumper strip 15 extend through the holes 43 formed in the grommet strip 16A and 16B and into predetermined ones of the holes 32 formed in the frame 12. The racket string 17 (FIG. 1A), as the racket 10 is being strung, passes through the aligned bumper strip holes 42 and grommet strip grommets 44 and the frame holes 32 in which such grommets 44 are inserted, and through the aligned bumper strip grommets 40 and grommet strip holes 43 and the frame holes 32 in which such grommets 40 are inserted. Upon the string 17 being tightened, the bumper strip is structurally integrated with the racket 10 by the string, and more specifically, the bumper strip 15, grommet strip 16A and 16B and the racket frame 12 are structurally integrated by the string. Thus, once the bumper strip 15 is so integrated, it cannot be removed from the racket 10 without removing the string 17 which in turn renders the racket inoperable for play.

Similarly, and concurrently with the structural integration of the bumper strip 15 with the racket 10, and upon the throatpiece 13 being inserted between the opposed intermediate frame portions 23—23 with the throatpiece projections 30 being inserted within the additional frame holes 34, the string 17 is also passed through the holes 28 formed in the throatpiece 13 (FIG. 5) and through predetermined ones of the holes 32 formed in the frame 12. Upon the string 17 being tightened, the intermediate frame portions 23—23 are forced inwardly, tightly against the sides 35 and the throatpiece 13 with sufficient force such that the tightened string 17 in cooperation with the throatpiece projections 30 received within the additional frame holes 34 cooperatively structurally integrates the throatpiece 13 and the frame 12.

It will be further understood that upon the racket being strung and the throatpiece 13 and frame 12 being structurally integrated as taught above, the throatpiece projections 30 and frame holes 34 permit limited relative movement between the throatpiece and the opposed intermediate frame portions 23 (FIGS. 1B and 4) whereby at least limited torsional rotation experienced by the opposed intermediate frame portions 23—23 upon a ball and the racket 10 impacting is accommodated and the structural integration between the throatpiece and the frame is not interrupted or destroyed.

Referring again to the structural integration of bumper strip 15 with the racket 10, it will be understood by those skilled in the art that it is within the contemplation and scope of the present invention to use the string with which the racket 10 is strung to structurally integrate the bumper strip 15 and the racket frame 13 either alone or in combination with a grommet strip such as grommet strip 16A–16B. It is of course expressly within the scope of the present invention to structurally integrate the bumper strip, grommet strip and frame in combination as taught above and claimed below. Also, it is within the contemplation of the present invention to structurally integrate the bumper strip and racket 10 using the string with which the frame is strung wherein individual grommets inserted through the frame holes 32 are utilized. Additionally, it will be understood that the bumper strip 15 may be provided with grommets formed along the entire length thereof and covering the upper peripheral portion 22 of the racket frame thereby eliminating the need for a separate grommet strip, or portion thereof, below the bumper strip; two grommet strips would then be provided to cover the balance of the upper frame portion 21 with the upper end of each such grommet strip being provided with at least one hole for receiving at least one grommet provided at a respective end of the bumper strip the same as shown at the middle portion of FIG. 14 with the combination of such bumper strip and two grommet strips being structurally integrated with the racket by the racket string.

Further, it will be understood by those skilled in the art that the string 17 may be a continuous single string or it may be comprised of two or more individual strings such as the individual main and horizontal strings typically used in the stringing of many game ball rackets.

In brief summary, it will be appreciated by those skilled in the game ball racket art that a racket embodying the present invention is provided without the use of any permanent fasteners, such as rivets, metal screws, or joining techniques such as welding, brazing and that a game ball racket wherein components are structurally integrated with the racket frame by utilizing the string with which the racket is strung provides ease and lower cost of manufacture than is present with the prior art racket manufacturing techniques. Additionally, the present invention permits a reduction in the weight of a game ball racket by eliminating the need for fasteners such as rivets, metal screws, or the adhesive metal deposited by joining techniques such as welding or brazing. Additionally, the assembly time of a racket embodying the present invention can be reduced as compared with prior art assembly times.

It will lastly be understood by those skilled in the art that many modifications and variations of the present invention may be made without departing from the spirit and the scope thereof.

What is claimed is:

1. In a game ball racket including a frame having an upper portion having a plurality of holes formed therealong, and further including a handle at the opposite end thereof, and still further including a grommet strip surrounding said upper portion of said frame and wherein said grommet strip is provided with a plurality of grommets extending inwardly therefrom and into predetermined ones of said holes formed in said frame, said grommets and said frame holes for receiving string and said upper portion of said frame having an upper peripheral portion, the improvement comprising:

said grommet strip being provided with a plurality of grommets at predetermined positions therealong and said grommets extending into predetermined ones of said holes formed in said racket frame and said grommet strip being further provided with a plurality of holes at predetermined positions therealong and which holes align with predetermined ones of said holes formed in said racket frame;

a bumper strip for surrounding said upper peripheral portion of said frame and for protecting against injury to one of two players upon one of said two players inadvertently striking the other player with said upper peripheral portion of said racket during the course of play with said racket;

said bumper strip provided with a plurality of grommets at predetermined positions therealong and said grommets extending into said predetermined holes formed in said grommet strip and into predetermined ones of said holes formed in said racket frame;

said bumper strip also being provided with a plurality of holes at predetermined positions therealong and which holes align with predetermined ones of said grommets provided on said grommet strip; and upon said racket being strung with said string, said string being received within (i) said grommets and said holes formed on said bumper strip and (ii) said grommets and said holes formed on said grommet strip, and upon said string being tightened, said string forcing said bumper strip and said grommet strip into tight engagement with said frame whereby said bumper strip is structurally integrated with said grommet strip and said frame and whereby said bumper strip cannot be removed from said racket without removing said string whereby said racket is rendered inoperable for play.

* * * * *